US005308176A

United States Patent [19]

Yamaguchi

[11] Patent Number: 5,308,176

[45] Date of Patent: May 3, 1994

[54] APPARATUS FOR CONVEYING PAPER IN A PRINTER

[75] Inventor: Naoto Yamaguchi, Suwa, Japan

[73] Assignee: Seiko Epson Corporation, Tokyo, Japan

[21] Appl. No.: 888,759

[22] Filed: May 27, 1992

[30] Foreign Application Priority Data

May 27, 1991 [JP] Japan ..... 3-121135
Feb. 26, 1992 [JP] Japan ..... 4-21299

[51] Int. Cl.[5] ..... B41J 13/03

[52] U.S. Cl. ..... 400/618; 400/625; 400/636.2

[58] Field of Search ..... 400/625, 605, 618, 582, 400/596, 621, 630, 636.2

[56] References Cited

U.S. PATENT DOCUMENTS

| | | | |
|---|---|---|---|
| 4,688,957 | 8/1987 | Prevignano | 400/605 |
| 4,929,105 | 5/1990 | Hirayama et al. | 400/582 |
| 5,050,858 | 9/1991 | Nakamura | 400/555 |
| 5,051,014 | 9/1991 | Takagi et al. | 400/625 |

*Primary Examiner*—Edgar S. Burr
*Assistant Examiner*—John S. Hilten
*Attorney, Agent, or Firm*—Stroock & Stroock & Lavan

[57] ABSTRACT

An apparatus for conveying paper in a printer adapted to convey cut-sheet and fan-fold paper bidirectionally in a paper path. The apparatus includes a paper discharging assembly positioned downstream of a print head and at least one paper conveying assembly positioned upstream of the print head. First and second power transmissions cooperate with the paper conveying and the paper discharging assemblies, respectively, to convey the paper in both a forward and reverse direction to desired printing positions and to convey the paper away from the print head. The paper conveying assembly grips the paper with greater force than the paper discharging assembly while the second power transmission has greater play b2 than the play b1 of the first power transmission. In order to convey the paper in the reverse direction the motor rotates a distance equal to b1 + an amount of rotation MAXd2 equal to the distance in the second direction to a desired second printing position from the first printing position absent any play) + (an additional amount of rotation $\gamma$). The motor then rotates in the forward position an amount equal to (b1 + $\gamma$) to drive the paper to the second desired printing position.

18 Claims, 10 Drawing Sheets

R
S
120

APPARATUS FOR CONVEYING PAPER IN A PRINTER

BACKGROUND OF THE INVENTION

This present invention is directed generally to an apparatus for conveying cut or fan-fold paper in a printer, and in particular, to a paper conveying apparatus which prevents slack from developing in the paper as it is conveyed in both the reverse and forward directions through the printer.

A conventional printer including an apparatus for conveying paper such as shown in Japanese Patent Application (OPI) No. 257871/1987 is illustrated in FIG. 1. The printer includes a platen 301, a sheet conveying roller 303, a print head 302, a first discharging roller 307 and a second discharging roller 308. Platen 301 and sheet conveying roller 303 form sheet conveying assembly 310. First discharging roller 307 and second discharging roller 308 form sheet discharging assembly 315. A printing sheet 100 is conveyed in the direction of the arrow G into the gap between platen 301 and print head 302 to a printing position (a). Print head 302 prints characters or data onto printing sheet 100 at printing position (a) as printing sheet 100 is conveyed through the printer. Printing sheet 100 is discharged by sheet discharging assembly 315. Sheet discharging assembly 315 is designed to discharge printing sheet 100 from the printer when the rear edge of printing sheet 100 has passed through the contact line of platen 301 and sheet conveying roller 303 (when the sheet conveying force applied to printing sheet 100 by sheet conveying assembly 310 has been suspended). The sheet conveying speed of sheet discharging assembly 315 is set to a value greater than that of sheet conveying assembly 310 while the sheet conveying force of the sheet discharging assembly 315 is set smaller than that of the sheet conveying assembly 310, so that printing sheet 100 is allowed to slip with respect to sheet discharging assembly 315. By this arrangement, printing sheet 100 is stretched tight when positioned between sheet conveying assembly 310 and sheet discharging assembly 315. This prevents slack from forming across paper sheet 100.

The conventional printer of FIG. 1 as described above was conceived based on the premise that printing sheet 100 is conveyed in the forward direction (sheet forward conveying direction) only. That is, no consideration is made for the case where a printing sheet is conveyed in the reverse direction (sheet reverse conveying direction), the direction opposite the forward direction.

When performing graphic printing operations using bit images and character printing operations using enlarged characters in combination, an ordinary printing method cannot be employed, because the capacity of the memory (buffer) in the printer or control software is limited. Therefore the following method should be employed. A plurality of lines are printed. Thereafter, the printing sheet is returned to the original position for another printing operation (i.e. graphics or enlarged characters). Thus, the printing of the sheet is accomplished as a whole. In this type of printing operation, it is essential to accurately convey the printing sheet (about ½ inch) in the reverse direction.

FIG. 2 illustrates the relationship between the amount of displacement of the printing sheet and the amount of rotation of the drive motor in the case where the sheet is conveyed in the forward direction and in the case where the sheet is conveyed in the reverse direction as carried out in a conventional printer of the type disclosed in Japanese Patent Application No. 257871/1987. In the case where printing sheet 100 is conveyed a distance D1, as shown in the first quadrant, the drive motor (not shown) should be rotated as much as d1 in the sheet forward conveying direction. Since the sheet conveying speed of sheet discharging assembly 315 is greater than the speed of sheet conveying assembly 310, sheet discharging assembly 315 tends to convey printing sheet 100 as much as the amount of displacement indicated by the broken line. Since the sheet conveying force of sheet discharging assembly 315 is smaller than that of sheet conveying assembly 310, printing sheet 100 is allowed to slip as much as S1 with respect to sheet discharging assembly 315. Hence, printing sheet 100 is conveyed to the point Pl from the origin while being stretched tight; that is, it is moved as much as D1.

In the case where the printing sheet 100 is conveyed only in the forward direction, even if there is an amount of play due to the backlash of the gear train between the drive motor, sheet conveying assembly 310 and sheet discharging assembly 315, the play is absorbed in one direction so the amount of rotation of the drive motor and the amount of displacement of printing sheet 100 are proportional to each other.

When the printer is to convey printing sheet 100 in the sheet reverse conveying direction after being conveyed in the forward direction, the drive motor is turned as much as dl in the reverse direction to convey printing sheet 100 in the reverse direction. However, printing sheet 100 does not move while the drive motor is turned in the reverse direction as much as a small amount of play (b), due to the backlash of the gear train between the drive motor, sheet conveying assembly 310 and sheet discharging assembly 315. Precisely stated, the amount of play between the drive motor and sheet conveying assembly 310 differs from the play between the drive motor and sheet discharging assembly 315. However, they are denoted by the same value (b) since they are generally small values (in FIG. 2, for convenience in description, (b) is about half d1, however, in practice, it is much smaller). After the play has been absorbed, sheet discharging assembly 315 displaces printing sheet 100 at a speed greater than the speed of sheet conveying assembly 310. As a result, sheet conveying assembly 310 displaces printing sheet 100 as much as D2 in the reverse direction, so that printing sheet 100 is moved through the origin and the point P2 to the point P3. On the other hand, while sheet discharging assembly 315 displaces printing sheet 100 in the reverse direction, printing sheet 100 is moved through the origin and the point P2 to the point P4. Thus, printing sheet 100 is slackened as much as the difference S2 between D2 and D3. In FIG. 2, D1>D3>D2, and printing sheet 100 differs in displacement in the forward and reverse directions, while the amount of rotation (d1) of the drive motor remains unchanged. Thereafter, when the drive motor is turned as much as d1, the amount of play (b) is absorbed in the opposite direction and the sheet is returned to the origin.

Printing sheet 100 is thus moved from the point P3 through the point P5 to the origin by sheet conveying assembly 310, whereas it is moved from the point P4 through the point P6 to the origin by sheet discharging assembly 315. As is apparent from the above description, when the printing sheet is conveyed in the reverse direction in a conventional printer, it is slackened, and as a result, the resultant print may be shifted in position, the printing sheet stained by ink or caught in the printer resulting in jamming.

In the case where print head 302 is of the wire impact dot type, the slack causes printing sheet 100 to be caught in the printer pushing the ink ribbon (not shown) located between print head 302 and platen 301 through the ribbon mask (not shown) positioned between print head 302 and platen 301 against print head 302, so that the wires of print head 302 are likely to be caught by the ink ribbon or broken. In addition, when the printing wires strike printing sheet 100 while it is raised away from platen 301, the printer emits a loud noise during printing.

Accordingly, it is desired to provide an apparatus for conveying paper in a printer which overcomes the disadvantages of the prior art device described above by providing an apparatus for conveying paper within a printer which eliminates slack during conveying in the reverse direction by applying tension to the recording medium when conveyed in either a forward or reverse direction thus preventing slack from occurring across the printing medium. Specifically, the problems which would be eliminated include the resultant print being shifted in position, the printing sheet being stained by ink or caught in the printer and the wires of the print head becoming damaged or broken.

SUMMARY OF THE INVENTION

Generally speaking, in accordance with the present invention, an apparatus for conveying paper within a printer adapted to convey both fan-fold and cut paper in reverse and forward directions is provided. The apparatus includes a print head for printing on paper. The apparatus also includes a paper conveying assembly provided upstream of a printing position in a sheet supplying direction, a sheet discharging assembly provided downstream of the printing position and a drive motor for driving the paper conveying assembly and the sheet discharging assembly through a power transmission system. The paper conveying speed of the sheet discharging assembly is set higher than that of the paper conveying assembly.

Play exists in the power transmission system which may be due to the backlash of the gear train thereof. The amount of play (b2) of the power transmission system between the drive motor and the sheet discharging assembly is larger than amount of play (b1) of the power transmission system between the drive motor and the paper conveying assembly. Specifically, the amount of play b2 is larger than play b1 + the amount of rotation d2 of the drive motor which, when no play is provided, is required for the paper conveying assembly to convey a printing sheet as much as a desired maximum amount of sheet reverse conveyance Max(D4-)+an amount of additional rotation $\gamma$.

The drive motor is rotated as much as $b1+d2+\gamma$ in the sheet reverse-conveying direction, and thereafter rotated as much as b1 and $\gamma$ in a sheet forward-conveying direction so that the printing sheet is conveyed in the sheet reverse-conveying direction as much as a desired amount of sheet reverse conveyance. The amount of sheet reverse conveyance is essentially ½ inch or more. Thus, the paper can be conveyed in both directions with high improved stability and accuracy.

Accordingly, it is an object of the present invention to provide an improved apparatus for conveying both fan-fold and cut paper in a printer.

Another object of the present invention is to provide an apparatus for effectively conveying fan-fold and cut paper, in both forward and reverse directions, in a printer.

Yet another object of the present invention is to provide an apparatus for conveying cut and fan-fold paper which eliminates slack when feeding the paper in either a forward or reverse direction.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figure 3:
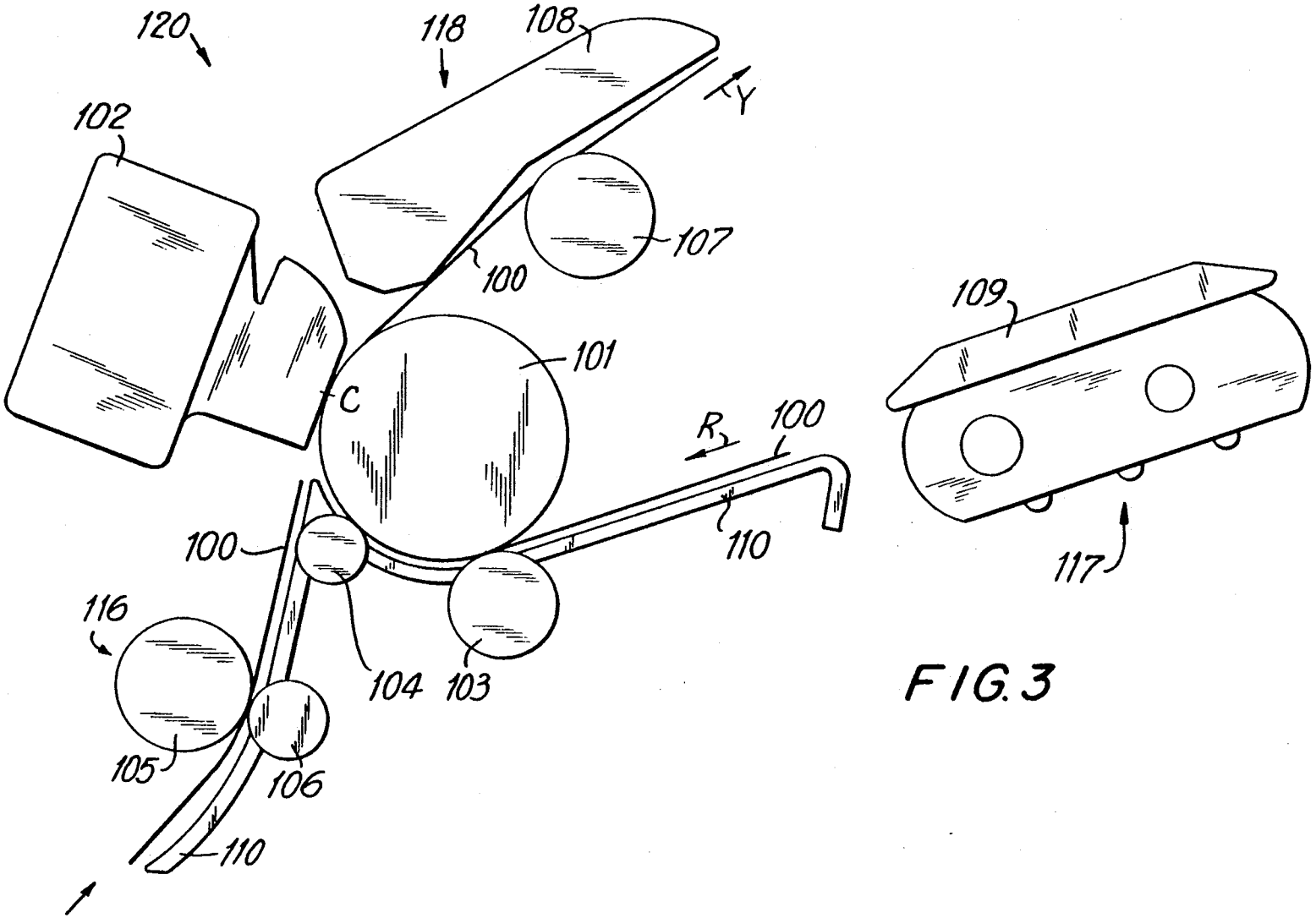
FIG. 3 is a schematic cross-sectional view of an apparatus for conveying paper constructed in accordance with a first embodiment of the present invention.
Figure 4:
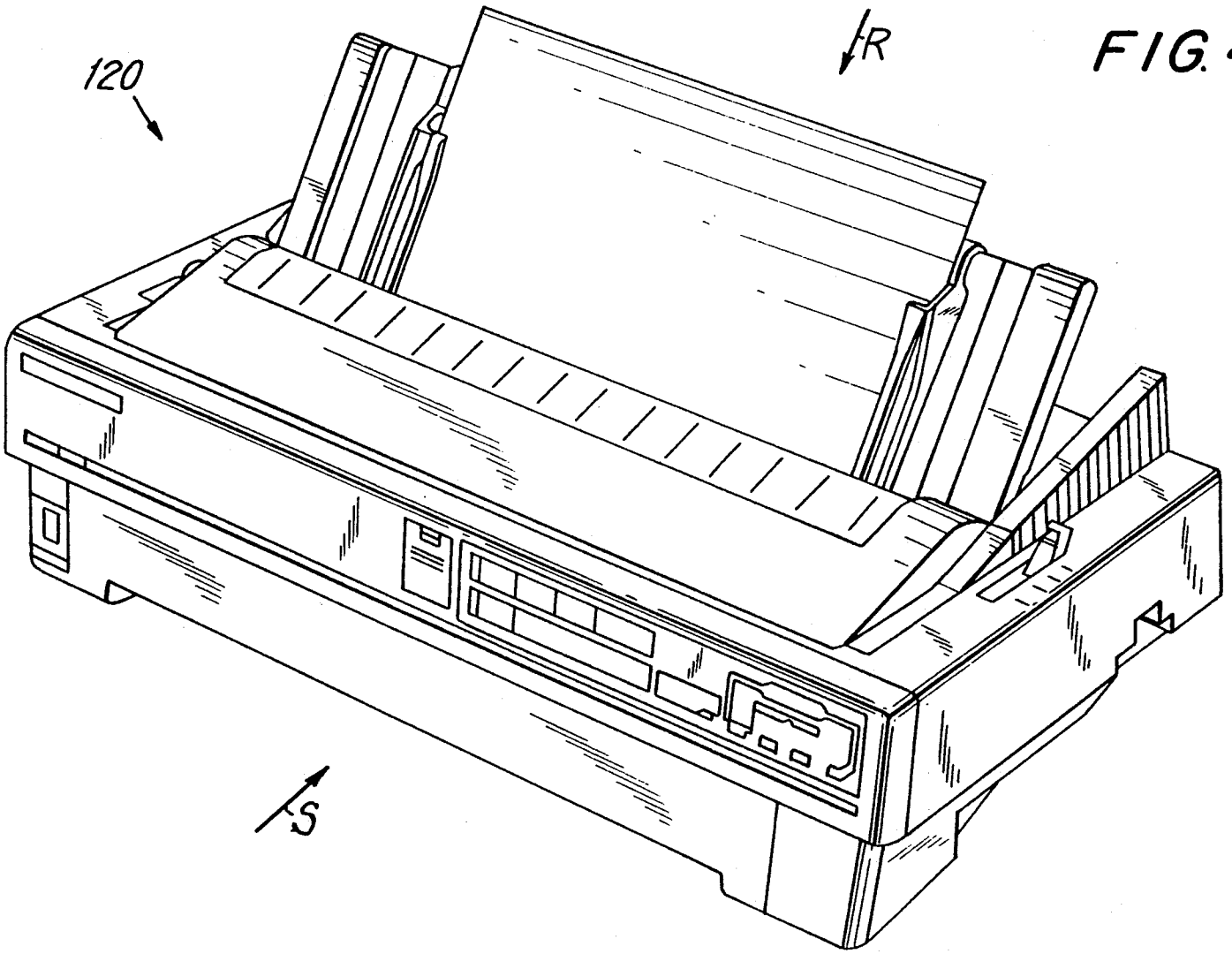
FIG. 4 is a perspective view of a printer including the apparatus for conveying paper in accordance with a first embodiment of the present invention.

Reference is made to FIGS. 3 and 4, wherein a printer generally indicated at 120 including a paper conveying apparatus, is depicted. Printer 120 has a sheet path R in which a paper 100 is inserted from above and behind, and a sheet path S in which paper 100 can be inserted from below and in front.

Reference is had to FIG. 3, wherein the pertinent components of the printer 120 are shown schematically. The printer includes a rotating platen 101, a print head 102, a first paper conveying roller 103, a second paper conveying roller 104, a paper conveying drive roller 105, a third paper conveying roller 106, a paper discharging roller 107, a paper discharging cover 108, a tractor 109 and a sheet guide 110. The printing center (printing position (c)) of print head 102 is positioned on a normal of platen 101, which can be formed of rubber or the like. Print head 102 and platen 101 are positioned so that they form a small gap therebetween. In the sheet path R upstream of printing position (c) on the sheet supplying side, first and second paper conveying rollers 103 and 104 are provided in such a manner that they are pushed against platen 101. Similarly, in the sheet path S, upstream of printing position (c) on the sheet supplying side, paper conveying drive roller 105 and third paper conveying roller 106 are provided in such a manner that they are pushed against each other. In addition, in sheet path R, tractor 109 can convey paper 100 in the form, for example, of continuous form or fan-fold paper to sheet guide 110. Platen 101, first paper conveying roller 103, and second paper conveying roller 104 form a first paper conveying assembly 115. Paper conveying drive roller 105 and third conveying roller 106 form a second paper conveying assembly 116. Tractor 109 forms a third paper conveying assembly 117.

Paper discharging roller 107 is provided in the sheet path Y, downstream of the printing position (c). Paper discharging roller 107 pushes paper 100 so that a predetermined paper discharging force is produced due to a predetermined gap between paper discharging roller 107 and paper discharging cover 108. Paper discharging roller 107 and paper discharging cover 108 discharge paper 100 downstream after the rear edge of paper 100 has passed paper conveying assembly 117. Paper discharging roller 107 and paper discharging cover 108 form paper discharging assembly 118. In order to eliminate slack from occurring across print sheet 100 between the paper conveying assemblies and the paper discharge assembly, the paper conveying speed of paper discharging assembly 118 is set higher than that of any one of the first paper conveying assembly 115, second paper conveying assembly 116 and third paper conveying assembly 117. Furthermore, in order to allow paper 100 to slip with respect to paper discharging assembly 118 to control the amount of conveyance of paper 100, the paper conveying force of paper discharging assembly 118 is set to a value smaller than that of any one of first paper conveying assembly 115, second paper conveying assembly 116 or third paper conveying assembly 117. Sheet guide 110 is provided so that paper 100 is led to printing position (c) through any one of sheet paths R and S. In first paper conveying assembly 115, first and second paper conveying rollers 103 and 104 are provided with a mechanism (not shown) for spacing them from platen 101 when necessary. Similarly, in second paper conveying assembly 116, third paper conveying roller 106 is provided with a mechanism (not shown) for spacing it from paper conveying drive roller 105 when required. In conveying a continuous printing sheet, the mechanism is operated so that first and second paper conveying rollers 103 and 104 are positionally spaced from platen 101, in order for tractor 109 to operate properly.

Figure 5:
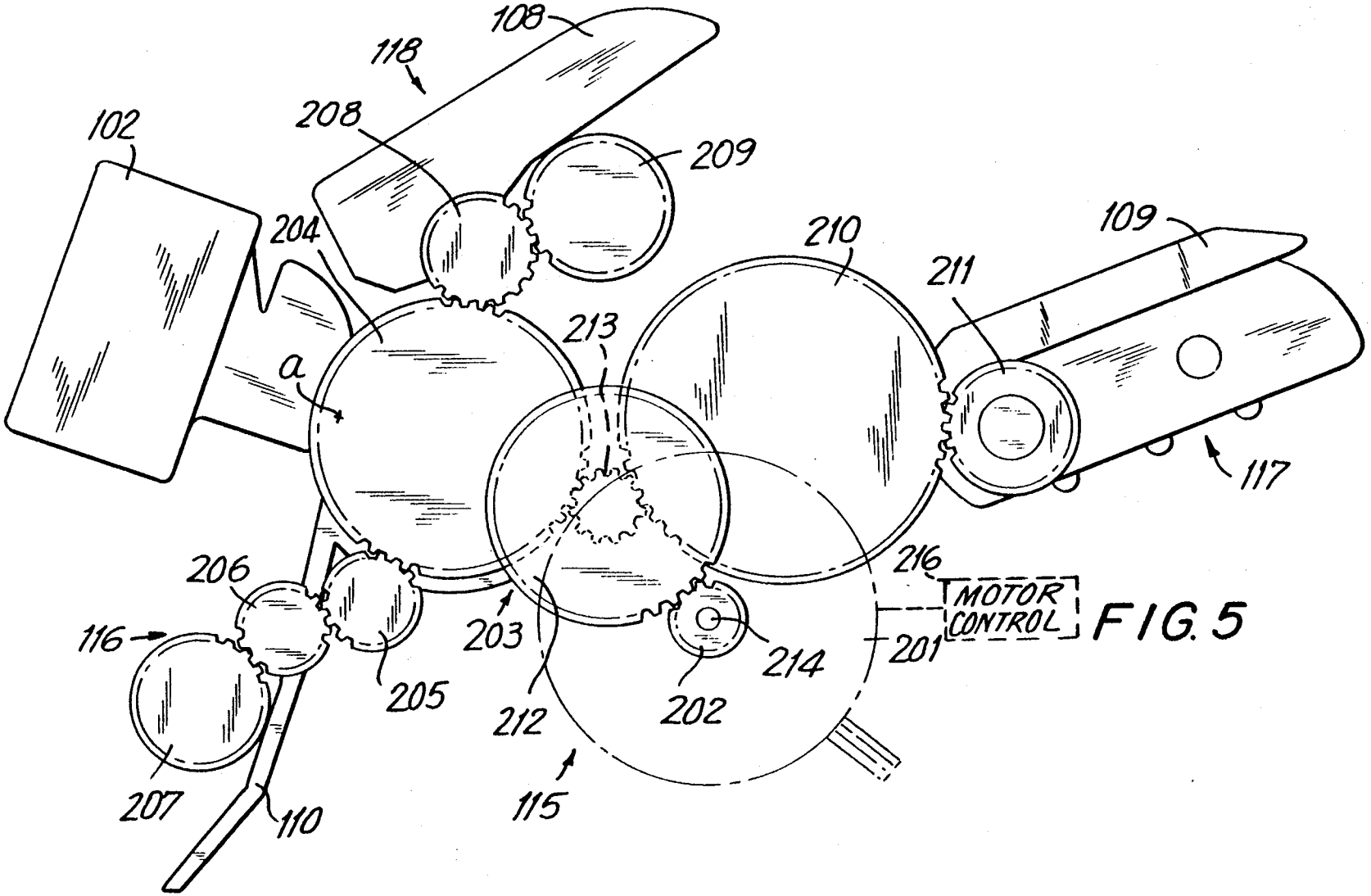
FIG. 5 is a schematic cross-sectional view illustrating the gear train in accordance with a first embodiment of the present invention.

Reference is made to FIG. 5, wherein the transmission system between a drive motor and the paper conveying assemblies and the paper discharging assembly for the apparatus for conveying paper of FIGS. 3 and 4, including the drive gear trains of the transmission, is depicted. Specifically, the drive gear trains are employed for a power transmission system between first, second and third paper conveying assemblies 115, 116 and 117 and a drive motor 201 and for a power transmission system between paper discharging assembly 118 and drive motor 201, so that drive motor 201 can drive the paper conveying assemblies 115, 116 and 117 and paper discharging assembly 118. A motor control 216 is included to control the amount and direction or rotation of drive motor 201. A motor pinion 202 is fixedly mounted on an output shaft 214 of drive motor 201. Motor pinion 202 is engaged with a large gear 212 of a reduction gear assembly 203, a small gear 213 which is engaged with a platen gear 204 and a fourth transmission gear 210. Small gear 213 and large gear 212 rotate as a unit. Platen gear 204 is engaged with a first transmission gear 205 and a third transmission gear 208 and is fixedly secured to platen 101 for common rotation. A paper conveying drive roller gear 207 is engaged with a second transmission gear 206 which is engaged with a first transmission gear 205. Paper conveying drive roller gear 207 and paper conveying drive roller 105 are fixedly mounted on the same shaft for common rotation. A tractor gear 211 is engaged with the fourth transmission gear 210, and is fixedly mounted on a shaft adapted to drive tractor 109. A paper discharging roller gear 209 is included in paper discharging assembly 118, downstream of the printing position (c), and is engaged with third transmission gear 208. Paper discharging roller gear 209 and paper discharging roller 107 are fixedly mounted on the same shaft for common rotation.

Figure 1:
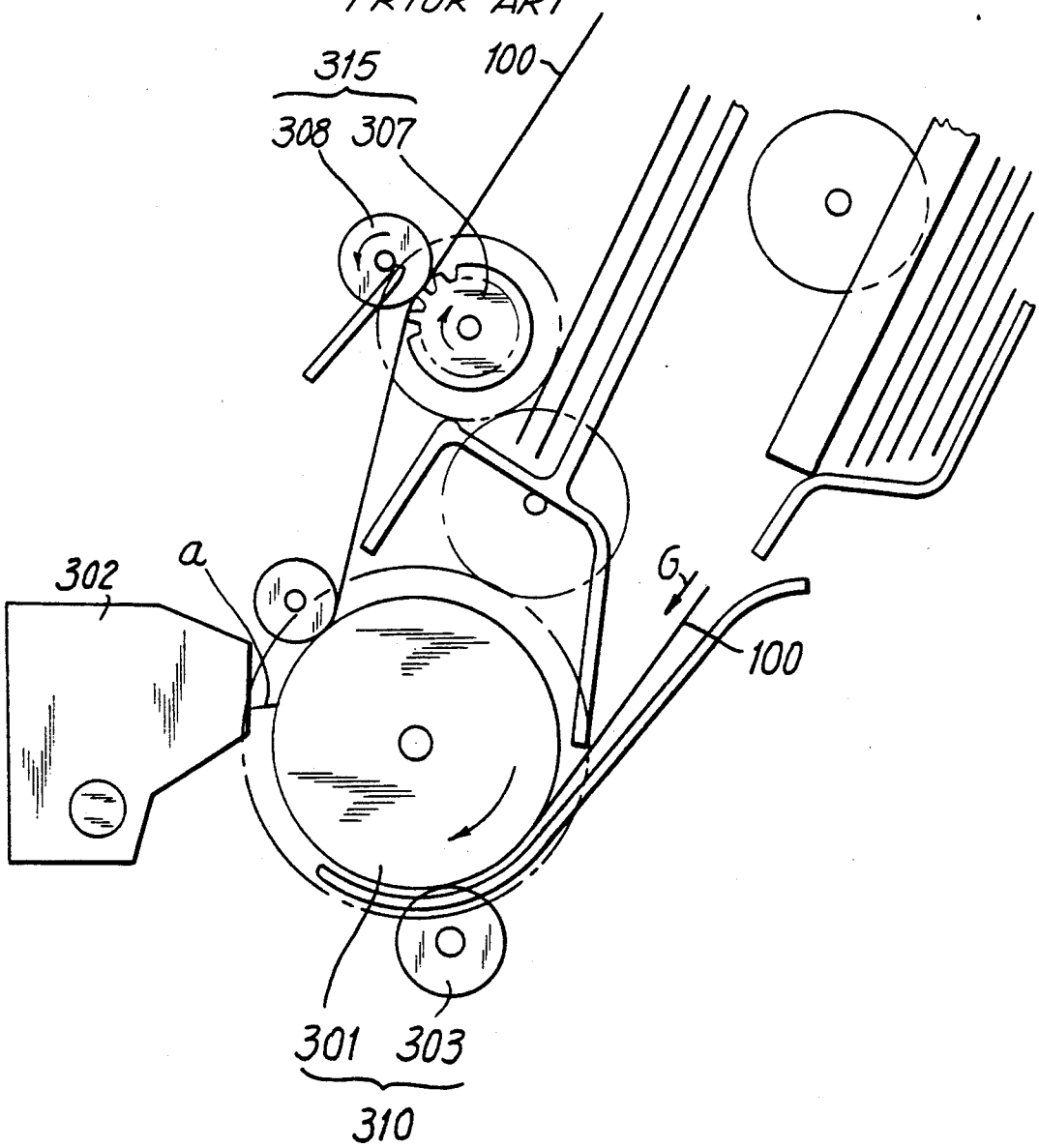
FIG. 1 PRIOR ART
FIG. 1 is a schematic cross-sectional view of an apparatus for conveying paper constructed in accordance with the prior art.
Figure 2:
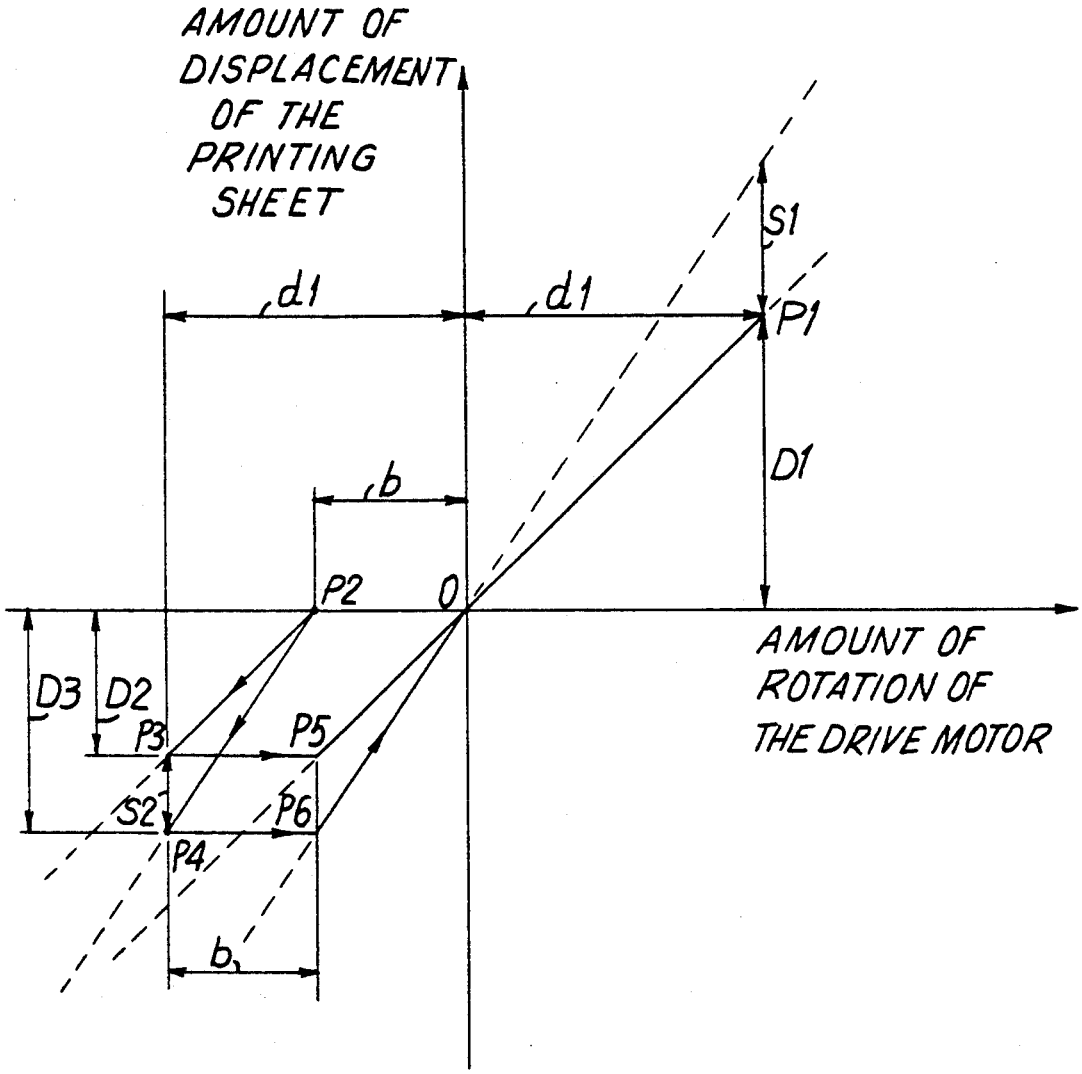
FIG. 2 PRIOR ART
FIG. 2 is a diagrammatic view showing the relationships between the amount of conveyance of a printing sheet and the amount of rotation of the drive motor.

Motor pinion 202, reduction gear assembly 203, platen gear 204, first transmission gear 205, second transmission gear 206, fourth transmission gear 210, paper conveying drive roller gear 207 and tractor gear 211 are profile positive shifted gears and have less backlash than standard gears. Therefore, an amount of play b1 due to the backlash of the power transmission systems between drive motor 201 and first conveying assembly 115, second paper conveying assembly 116 and third paper conveying assembly 117 or tractor 109 is small, similar to the amount of play due to the backlash between the drive motor and the paper conveying assembly and paper discharging assembly in the prior art as described in FIGS. 1 and 2. Since those gears are profile positive shifted gears as was described above, the distance between the axes of adjacent gears (hereinafter referred to as "an inter-axes distance") is set larger than the sum of the pitch circle diameters of the gears. The teeth thickness of a profile positive gear is thicker than that of a normal gear.

Figure 6:
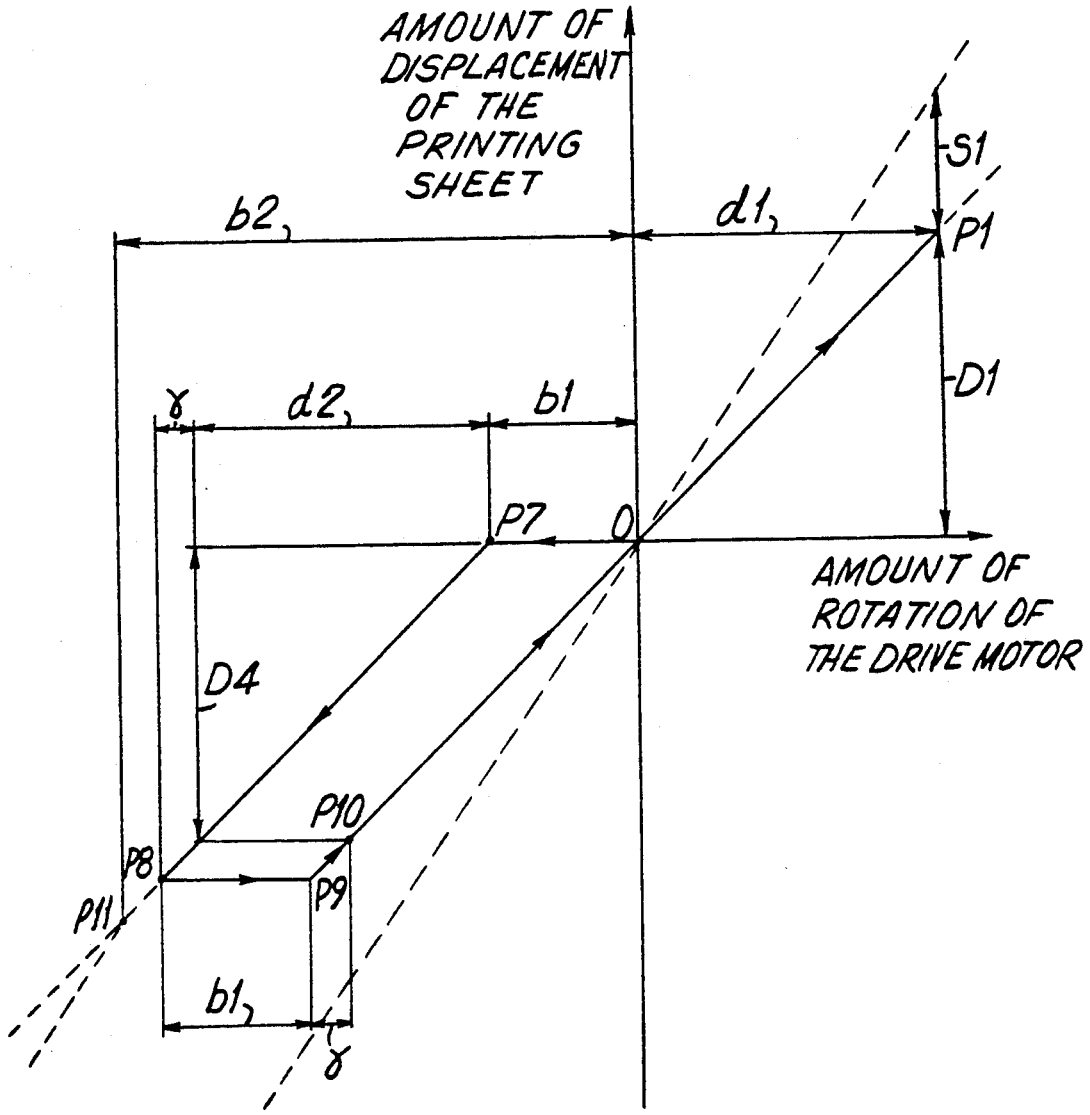
FIG. 6 is a diagrammatic view showing the relationship between the amount of displacement of a printing sheet and the amount of rotation of a drive motor of the apparatus for conveying paper in accordance with a first embodiment of the present invention.

On the other hand, the amount of play between the paper discharging assemblies and the drive motor is set as follows: the inter-axes distances of platen gear 204, third transmission gear 208 and paper discharging roller gear 209 are increased, and the third transmission gear 208 and paper discharging roller gear 209 are profile negative shifted gears (the inter-axes distance is set smaller than the sum of the pitch circle diameter of the gears), thus increasing the backlash. The teeth thickness of a profile negative gear is thinner than that of a normal gear. Thus, the amount of play between paper discharging assembly 118 and drive motor 201 is set to b2, which is much larger than of play b1 of the power transmission system between drive motor 201 and each of first, second and third paper conveying assemblies 115, 116 and 117. A method of setting play b2 will be described with reference to FIG. 6 below.

In first paper conveying assembly 115, the rotation of drive motor 201 is in the forward direction with respect to a paper conveying direction when conveying paper ("forward rotation" or "clockwise rotation"). The rotation of the drive motor in reverse will be referred to as "reverse rotation" or "counterclockwise rotation."

Figure 7A:
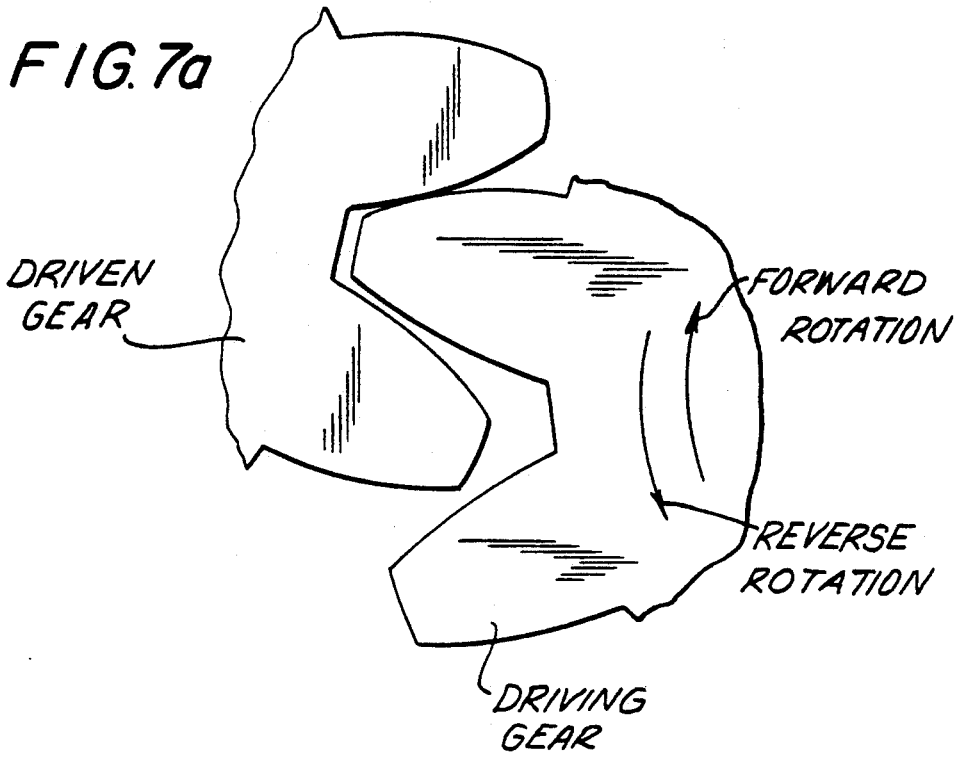
FIGS. 7(*a*) and 7(*b*) are diagrammatic views of the backlash of the gear train of the apparatus for conveying paper in accordance with a first embodiment of the present invention.
Figure 7B:
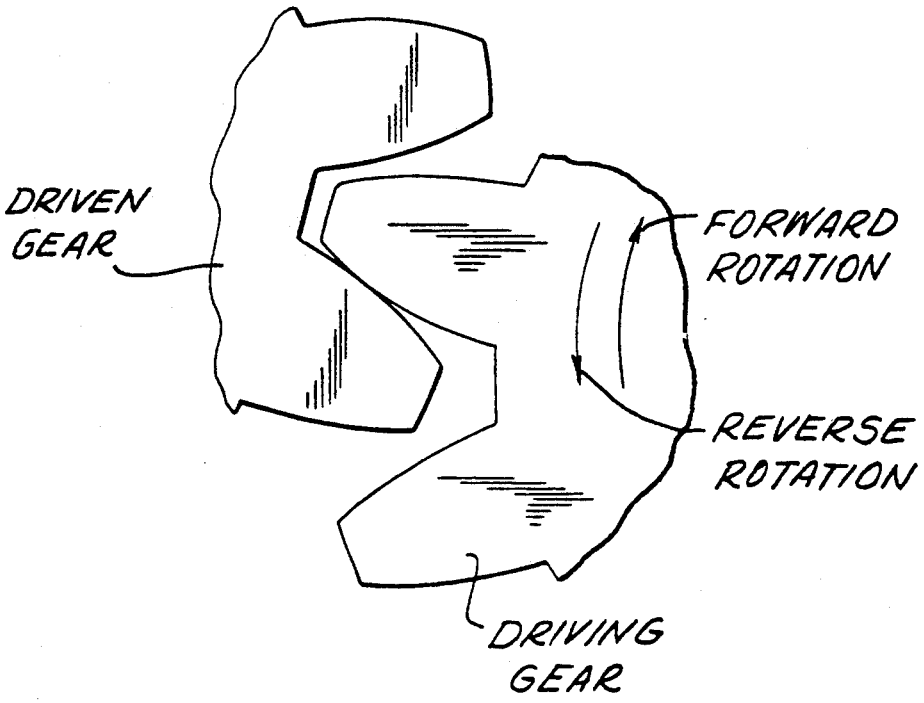

The relationships between the rotation of drive motor 201 and the conveyance of paper 100 will be described with reference to FIGS. 3, 5, 6, 7(*a*) and 7(*b*) . The torque produced when drive motor 201 is rotated as much as d1 clockwise, is applied through motor pinion 202 and reduction gear assembly 203 to platen gear 204 to turn platen 101 clockwise. The torque is further applied through third transmission gear 208 to paper discharging roller gear 209 to turn paper discharging roller 107 clockwise. In this operation, paper 100 inserted through the sheet path R is conveyed as much as D1 in the forward direction by first paper conveying assembly 115, thus being supplied along sheet guide 110. Paper 100 is passed through first conveying roller 103 and second paper conveying roller 104 which are pushed against platen 101, through the gap between platen 101 and print head 102, and through the gap between paper discharging roller 107 and paper discharging cover 108. Paper 100 is thus discharged into the sheet path Y. When paper 100 is threaded through both paper conveying assembly 115 and paper discharging assembly 118, paper discharging roller 107 of paper discharging assembly 118 rotates a distance sufficient to convey paper 100 as much as the amount of displacement indicated by the broken line in the first quadrant of FIG. 6 because paper discharging assembly 118 rotates faster than first paper conveying assembly 115. However, since the paper conveying force of paper discharging assembly 118 is smaller than that of first paper conveying assembly 115, paper 100 is allowed to slip, as much as S1, with respect to paper discharging assembly 118. Thus, paper 100 is only moved from the origin to the point Pi along the solid line, while being stretched tight (conveyed as much as D1) . In the case where paper 100 is conveyed in the forward direction as described above, the play due to the backlash of the gear trains between drive motor 201 and first paper conveying assembly 115 and between drive motor 201 and paper discharging assembly 118 is absorbed in one direction as shown in FIG. 7(*a*), and therefore the amount of rotation of drive motor 201 and the amount of conveyance of paper 100 are in proportion to each other.

With paper 100 in contact with both first paper conveying assembly 115 and paper discharging assembly 118, a signal for conveying paper 100 in the opposite direction (hereinafter referred to as "a sheet reverse-conveying signal") is applied to drive motor 201, which begins turning counterclockwise. The torque produced by drive motor 201 is transmitted through motor pinion 202 and reduction gear assembly 203 to platen gear 204 to turn platen gear 204 counter-clockwise. The torque is further applied through third transmission gear 208 to paper discharging roller gear 209 to turn paper discharging roller 107 counter-clockwise. When it is required to displace paper 100 as much as a desired amount of conveyance D4 in the opposite direction (hereinafter referred to as "an amount of sheet reverse conveyance D4"), drive motor 201 is turned in the reverse direction as much as [the amount of play b1 due to the backlash of the power transmission system between paper conveying assembly 115, 116 or 117 and drive motor 201]+[the amount of rotation d2 of drive motor 201 with which, when no play is provided, paper conveying assembly 115, 116 or 117 conveys paper 100 as much as the amount of sheet reverse conveyance D4]+[a small amount of additional rotation $\gamma$]. As a result, paper 100 is moved from the origin to the point P8 via P7 in FIG. 6. While the paper is moved from the origin to the point P7, the backlash of the gear train between drive motor 201 and paper discharging assembly 118 changes from the state shown in FIG. 7(*a*) to the state shown in FIG. 7(*b*) . If, in this case, the amount of play b2 of the power transmission system between paper discharging assembly 118 and driver motor 201 is set larger than [b1]+[the amount of rotation (d2) of drive motor 201 with which, when no play is provided, paper conveying assembly 115, 116 or 117 conveys paper 100 as much as a desired maximum amount of sheet reverse conveyance Max (D4)]+[$\gamma$], then paper discharging assembly 118 is not driven during the reverse conveyance operation, and paper 100 will not be slackened between first paper conveying assembly 115 and paper discharging assembly 118. Point P11, defined by a dashed line, is the point to which the paper would move if the reverse conveyance operation absorbed the full play b2.

In this embodiment, the maximum amount of sheet reverse conveyance Max(D4) is set to about ½ inch, taking into consideration printing operations for graphic printing using bit images and/or character printing including enlarged characters (e.g., 32 point printing) are carried out in combination. When it is necessary to print characters larger than 32 point, play b2 should be increased accordingly.

Thereafter, drive motor 201 is rotated as much as [b1 +$\gamma$] in the forward direction, so that paper 100 is moved from point P8 through point P9 to point P10 (paper 100 is moved as much as the desired amount of sheet reverse conveyance D4). When drive motor 201 is further rotated as much as d2, the sheet is moved from point P10 to the origin, the initial position. In the above-described operation, in the interval of P9–P10–Origin, one of first paper conveying assembly 115, second paper conveying assembly 116 and third paper conveying assembly 117 are driven in the forward direction while paper discharging assembly 118 is not driven. In order to make the paper conveying force of paper discharging assembly 118 smaller than that of first, second or third paper conveying assemblies 115, 116, 117, the force of contact of paper discharging assembly 118 with paper 100 is made relatively small, and paper discharging roller 107 is allowed to race. Hence, paper 100 conveyed by first paper conveying assembly 115 in the forward direction after reverse conveyance is passed through the gap between paper discharging roller 107 and paper discharging cover 108 without being slackened between platen 101 and paper discharging assembly 118 due to its stiffness against buckling, and finally paper 100 is discharged out of printer 120.

In the case of conveying a printing sheet such as one formed from air mail letter paper, which is extremely thin and lacks stiffness, a mechanism is provided which causes paper discharging roller 107 to move away from paper discharging cover 108 when necessary. Hence, in the interval of P9–P10–Origin, similarly as in the case the thicker of paper 100 discussed above, the extremely thin cut printing sheet can be discharged without being slackened by operating the mechanism to move paper discharging roller 107 away from paper discharging cover 108.

Second paper conveying assembly 116 provided in sheet path S is different from first paper conveying assembly 115 in that it comprises paper conveying drive roller 105 and third paper conveying roller 106. Paper 100 is inserted in the different direction, and drive roller 105 rotates in the direction opposite the rotation of drive motor 201 (as drive motor 201 rotates clockwise (in the forward direction), paper conveying drive roller 105 is rotated counter-clockwise). However, in second paper conveying assembly 116, as drive motor 201 is rotated in the forward direction, paper 100 is conveyed downstream in the sheet path. Thus, the function and control of second paper conveying assembly 116 is the same as first paper conveying assembly 115 except that it is in paper path S.

Tractor 109 (third paper conveying assembly 117), provided for in sheet path R, is substantially equal in function to first paper conveying assembly 115. Tractor 109 is employed instead of platen 101, first paper conveying roller 103 and second paper conveying roller 104 of first paper conveying assembly 115, to convey a continuous sheet instead of cut paper 100. Tractor 109 rotates in the opposite direction of drive motor 201 (as the drive motor 201 rotates clockwise in the forward direction, tractor gear 211 rotates counterclockwise). However, as drive motor 201 is rotated in the forward direction, the paper is conveyed downstream of sheet path R. Otherwise, tractor 109 operates the same as first paper conveying assembly 115. It should be noted that, before tractor 109 is operated, first and second paper conveying rollers 103 and 104 are spaced apart from platen 101, in order for tractor 109 to function properly.

The above-described embodiment has three paper conveying assemblies and two sheet paths; however, the invention is not limited thereto or thereby. That is, the printer should have at least one paper conveying assembly and one sheet path. The paper conveying assembly can be provided at any position upstream of the printing position (c).

Figure 8:
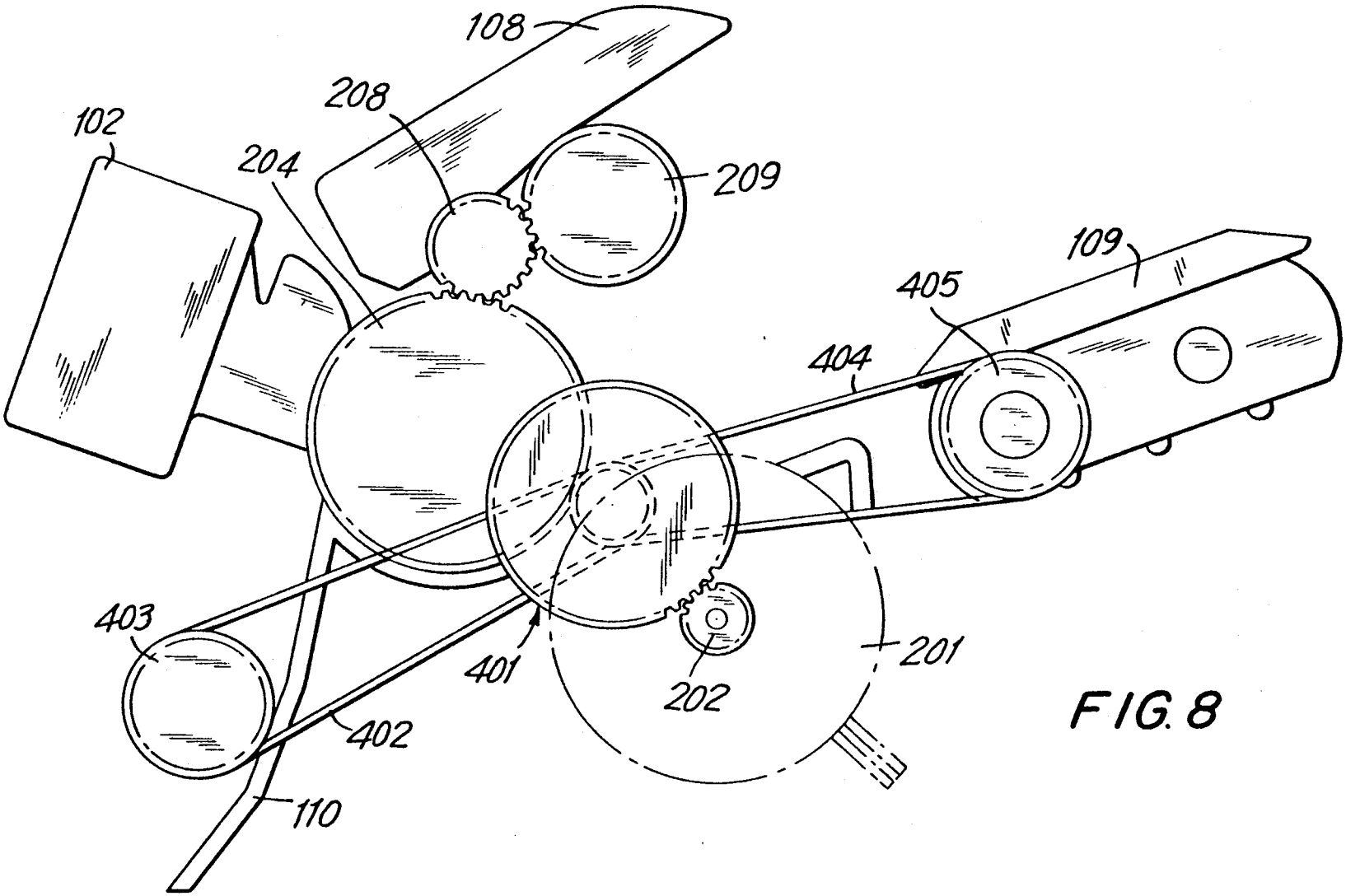
FIG. 8 is a schematic cross-sectional view of an apparatus for conveying paper constructed in accordance with a second embodiment of the present invention.

Specific reference is had to FIG. 8 which illustrates an apparatus for conveying paper in accordance with a second embodiment of the invention. A first endless belt 402, a second endless belt 404, a speed reduction pulley 401, a paper conveying drive roller pulley 403 and a tractor pulley 405 are employed in place of the first transmission gear 205, second transmission gear 206 and fourth transmission gear 210 of the first embodiment and serve the same function as the corresponding elements in the first embodiment. First endless belt 402 and second endless belt 403 greatly reduce the amount of play b1 in the power transmission systems between drive motor 201, second conveying assembly 116 and tractor 109 while also decreasing the fluctuation in the amount of play b1.

Figure 9:
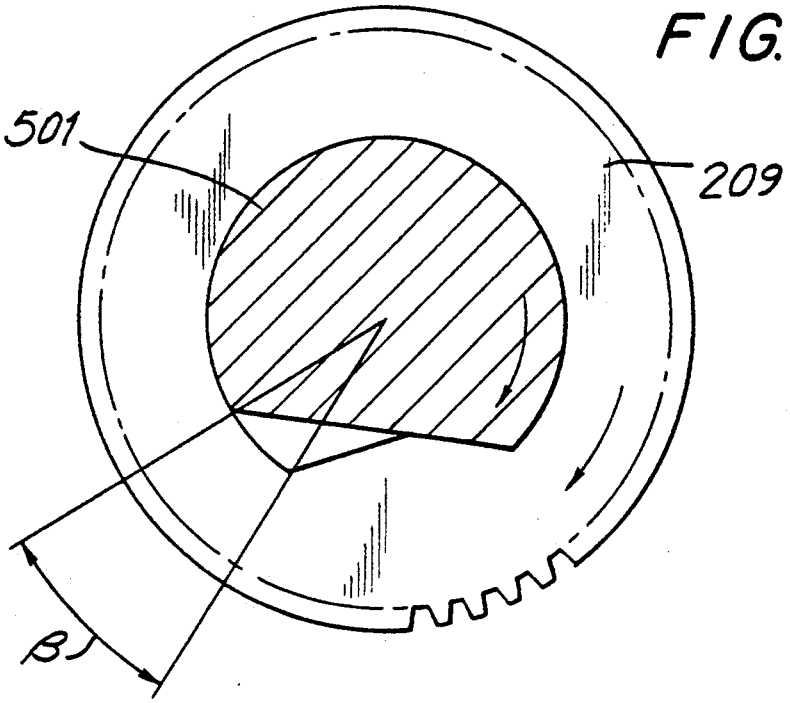
FIG. 9 is a cross-sectional view of a roller gear and roller shaft during clockwise rotation constructed in accordance with a third embodiment of the present invention.
Figure 10:
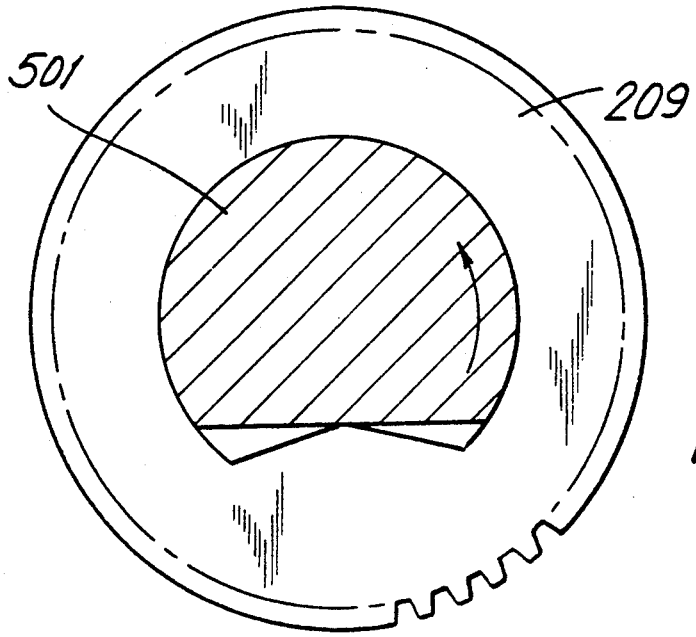
FIG. 10 is a cross-sectional view of a roller gear and a roller shaft during counter-clockwise rotation constructed in accordance with a third embodiment of the present invention.

FIGS. 9 and 10 illustrate the operation of a third embodiment of an apparatus for conveying paper in accordance with the invention. Paper discharging assembly 118 includes a paper discharging roller gear 209 with a sector-shaped hole and a paper discharging roller shaft 501 which is essentially in the form of the character "D" in section which is formed by extending one of the sides of the sector. Paper discharging roller shaft 501 is engaged with the sector-shaped hole of paper discharging roller gear 209. Since the paper discharging roller shaft 501 is essentially D-shaped in section as was described above, there is a gap corresponding to an angle of rotation $\beta$ between paper discharging roller shaft 501 and the sector-shaped hole of roller gear 209.

As discussed above with respect to the first embodiment, the amount of play b1 of the power transmission system between drive motor 201 and the first, second or third paper conveying assembly 115, 116 or 117 is decreased, and the backlash of the gear train between paper discharging assembly 118 and drive motor 201 is increased, so the following relation is established:

$$[b1]+[\mathrm{Max}(d2)]+[\gamma]<[b2]$$

On the other hand, in the third embodiment, the sector-shaped hole is formed in paper discharging roller gear 209 while paper discharging roller shaft 501, coupled for common rotation to sheet discharging roller 107, is made D-shaped in section so that the angle of rotation $\beta$ is formed therebetween, and the same relation is established. In other words, the angle $\beta$ corresponds to and provides the play b2 in accordance with the invention.

While paper discharging roller gear 209 has the sector-shaped hole, and the paper discharging roller shaft 501 is D-shaped in section, the invention is not limited thereto or thereby. That is, the hole of roller gear 209 and the section of roller shaft 501 may be different in configuration from those which have been described above, as long as the angle of rotation $\beta$ is obtained and the torque applied to paper discharging roller gear 209 is transmitted to paper discharging roller shaft 501.

When drive motor 201 is rotated clockwise (in the forward direction), paper discharging roller gear 209 is also rotated clockwise, and therefore paper discharging roller gear 209 is engaged with paper discharging roller shaft 501 as shown in FIG. 9. When the sheet reverse-conveying signal is inputted, drive motor 201 is rotated counter-clockwise, first paper conveying assembly 115 or second conveying assembly 116 or third conveying assembly 117 is rotated with the amount of play b1 absorbed immediately, so that paper discharging roller gear 209 and paper discharging roller shaft 501 are engaged with each other as shown in FIG. 10. As is apparent from the above description, the third embodiment creates play in contrast to that of the first embodiment. However, the combination roller gear and roller shaft perform the same function and control as first paper conveying assembly 115 and second paper conveying assembly 116 and third paper conveying assembly 117 as mentioned above with respect to the first embodiment except that in the this embodiment, in controlling the amount of play, it is unnecessary to perform intricate component control as in the first embodiment such as controlling the shift of the gears in order to control the amount of play.

Figure 11:
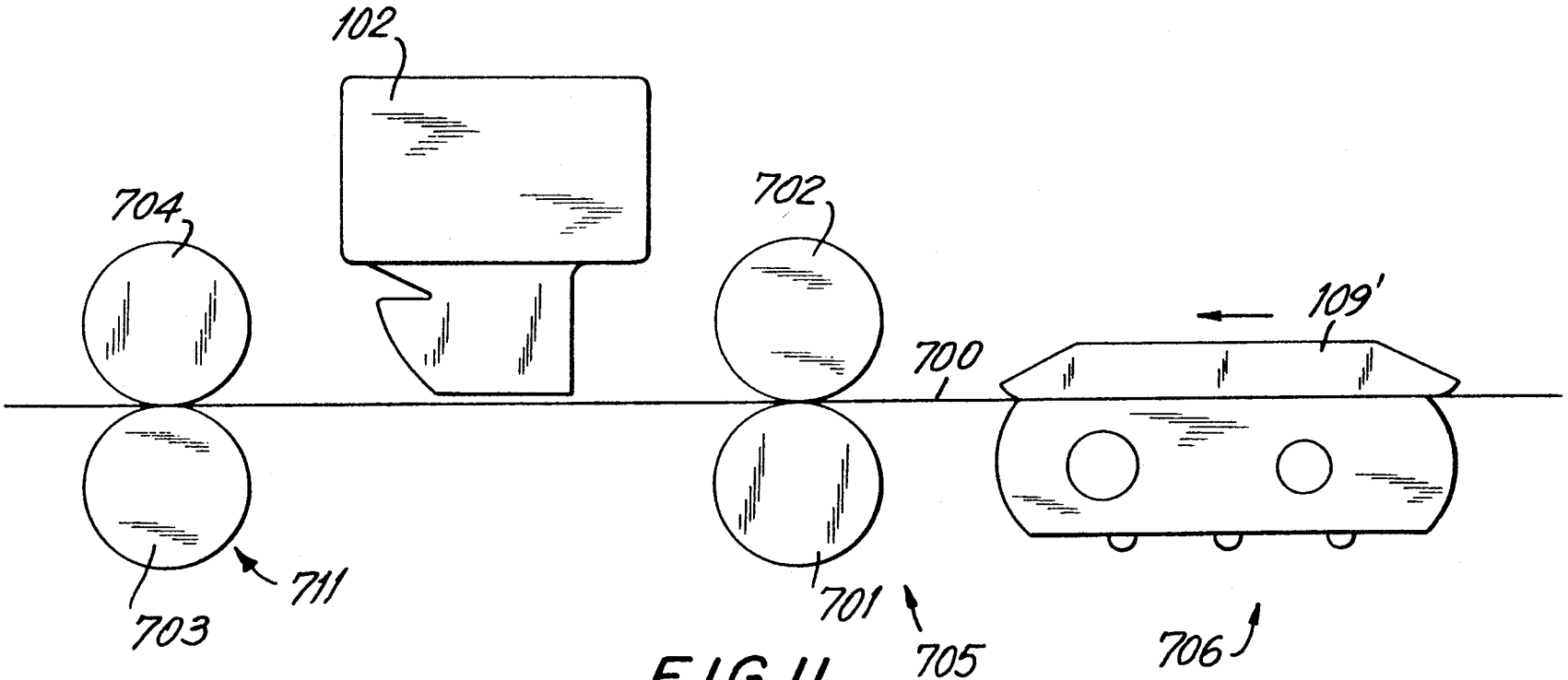
FIG. 11 is a schematic side elevational view of an apparatus for conveying paper constructed in accordance with a fourth embodiment of the present invention.

Specific reference is had to FIG. 11 which is a diagram showing an apparatus for conveying paper in accordance with a fourth embodiment of the invention. In the fourth embodiment, a first paper conveying assembly 705 includes a paper conveying drive roller 701 and a paper conveying roller 702. A second paper conveying assembly 706 includes a tractor 109'. A paper discharging assembly 711 includes a paper discharging drive roller 703 and a paper discharging roller 704 arranged linearly to improve the conveyance of a paper 700. The components of the fourth embodiment perform the same function and control as the corresponding components in the first embodiment.

By providing an apparatus for conveying paper which includes a paper conveying assembly in accordance with the invention, the amount of play b2 of the power transmission system between the drive motor and the paper discharging assembly is so set as to meet the following relation:

[the amount of play b1 of the power transmission system between the paper conveying assembly and the drive motor]+[the amount of rotation Max(d2) of the drive motor with which, when no play is provided, the paper conveying assembly displaces the paper as much as a desired maximum amount of sheet reverse conveyance Max (D4)]+[a small amount of additional rotation $\gamma$]<[the amount of play b2 of the power transmission system between the paper discharging assembly and the drive motor].

When it is required to convey the paper as much as a desired amount of sheet reverse conveyance D4 in the reverse direction, the drive motor is rotated as much as [b1+d2+$\gamma$] in the reverse direction, and then rotated as much as [b1+$\gamma$] in the forward direction so that the paper is prevented from being slackened between the paper conveying assembly and the paper discharging assembly. Accordingly, the paper is not raised between the paper conveying assembly and the paper discharging assembly thus preventing the print from being shifted in position and the paper stained by ink, or caught in the printer. Furthermore, in the case where the print head is a wire impact dot type, the printing wire is prevented from being caught by the ink ribbon, and broken. In addition, the printer of the invention also prevents the loud noise during printing which is produced when printing wire strikes the slackened paper which is raised away from the platen.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An apparatus for conveying paper in a printer along a paper path past a print head, in a first direction and in a second direction opposite to the first direction, comprising:

paper conveying means positioned upstream of said print head for applying force to said paper to selectively convey said paper along said paper path;

paper discharging means positioned downstream of said print head for applying force to said paper to selectively convey said paper along said paper path away from said print head in said first direction;

driving means for driving said paper conveying means and said paper discharging means in said first direction and at least said paper conveying means in said second direction;

said paper discharging means being displaced at a faster rate than said paper conveying means;

said driving means driving said paper conveying means and said paper discharging means in said first direction to convey paper in said first direction to at least one predetermined printing position;

said driving means being adapted to drive at least said paper conveying means in said second direction to convey said paper in a second direction a predetermined distance from said at least one predetermined printing position past a second predetermined printing position and to then drive said paper conveying means in said first direction to convey said paper to said at least second predetermined printing position;

said driving means including a drive motor, a first and second power transmission means for respectively operationally coupling said drive motor with each of said paper conveying means and said paper discharging means, said first power transmission means having a play b1 and said second power transmission means having a play b2;

Max(D4) being greater than zero and equal to a length of paper to be conveyed in said second direction from said at least one predetermined printing position to a second predetermined position if play b1 equalled 0, Max(d2) being greater than zero and equal to the amount of rotation of said drive motor required to convey said paper the length Max(D4) in said second direction, and $\gamma$ being greater than zero and equal to an additional amount of rotation of said drive motor; and said play b2 being greater than (play b1+said amount of rotation Max(d2) of said drive motor +said additional predetermined amount of displacement $\gamma$).

2. The apparatus for conveying paper of claim 1, wherein said paper is fan-fold paper.

3. The apparatus for conveying paper of claim 2, wherein said first conveying means includes tractor means for selectively conveying said fan-fold paper in the first and second directions.

4. The apparatus for conveying paper of claim 1, wherein said first power transmission means includes a first gear train means, said first gear train means having teeth, said play b1 being at least in part backlash between said teeth of said first gear train means.

5. The apparatus for conveying paper of claim 4, wherein said second power transmission means includes a second gear train means, said second gear train means having teeth, said play b2 being at least in part backlash between said teeth of said second gear train means.

6. The apparatus for conveying paper of claim 1, wherein said second power transmission means includes a wheel having a shaped aperture centrally therein and a shaft having a shaped cross-section in registration with said shaped aperture, said shaft and wheel being shaped for coordinated rotational displacement at at least one relative position of said shaped aperture and shaped cross-section when paper is conveyed in said first direction, while permitting relative rotational displacement of said wheel and shaft from said one relative position when paper is conveyed in said second direction to define said play b2.

7. The apparatus for conveying paper of claim 1, wherein said motor means advances in the second direction a predetermined amount equal to play b1+d2+$\gamma$ to convey said paper in a second direction past said second predetermined printing position.

8. The apparatus for conveying paper of claim 7, wherein said motor means, after said advancement in said second direction, advances a predetermined amount equal to b1+$\gamma$ in a first direction to convey said paper to said second predetermined printing position.

9. The apparatus for conveying paper of claim 8, wherein said amount of displacement Max(D4) corresponding to MAX(d2) is about 0.5 inches.

10. The apparatus for conveying paper of claim 1, wherein said first power transmission means includes an endless belt.

11. The apparatus for conveying paper of claim 1, wherein said paper conveying means, said paper discharging means and said print head are positioned linearly within said printer.

12. The apparatus for conveying paper of claim 1, and including platen means having a round cross-section and cooperating with said print head with said paper therebetween to effect printing, said paper conveying means and paper discharging means being positioned at spaced circumferential positions about said platen means.

13. The apparatus for conveying paper of claim 1, and including at least two of said paper conveying means.

14. The apparatus for conveying paper of claim 1, wherein the force applied by said paper conveying means exceeds the force applied by said paper discharging means.

15. A method for conveying paper within a printer along a paper path in a first direction and then in a second direction opposite the first direction past a print head utilizing a paper conveying means for conveying the paper along the paper path relative to the print head, and a paper discharging means for conveying paper away from said print head in said first direction and driving means for at least affirmatively driving said paper conveying means in said first and second directions through a first power transmission means having a play b1 and said paper discharging means through a second power transmission means having a play b2, comprising the steps of:

setting the speed of paper displacement of said paper discharging means greater than the speed of paper displacement of said paper conveying means;

conveying the paper in the first direction to at least one predetermined printing position by affirmatively driving said paper conveying means by said driving means;

conveying the paper in the second direction from said at least one predetermined printing position past a second predetermined printing position by affirmatively driving said paper conveying means by said driving means;

conveying the paper in the first direction to said second predetermined printing position by affirmatively driving said paper conveying means by said driving means;

displacing the paper discharging means at a faster rate than the paper conveying means;

Max(D4) being greater than zero and equal to a length of paper to be conveyed in said second direction from said at least one predetermined printing position to a second predetermined position if play b1 equalled 0, Max (d2) being greater than zero and equal to the amount of rotation of said drive motor required to convey said paper the length Max (D4) in said second direction, and $\gamma$ being greater than zero and equal to an additional amount of rotation of said drive motor; and selecting said first and second power transmission means so that play b2 is greater than play b1 and so that said play b2 is greater than (play b1+said amount of rotation Max(d2) of said drive motor+-said additional predetermined amount of displacement $\gamma$).

16. The method for conveying paper of claim 15, including the step of advancing the motor means in the second direction a predetermined amount equal to play b1+d2+$\gamma$ to convey said paper in said second direction past said second predetermined printing position.

17. The method for conveying paper of claim 16, including the further step of advancing said motor means after said advancement in said second direction, a predetermined amount equal to b1+$\gamma$ in a first direction to convey said paper to said second predetermined printing position.

18. The method for conveying paper of claim 17, wherein the amount of displacement Max(D4) corresponding to Max(d2) is about 0.5 inches.

* * * * *